US009939109B2

(12) United States Patent
Drube et al.

(10) Patent No.: US 9,939,109 B2
(45) Date of Patent: Apr. 10, 2018

(54) BULK LIQUID COOLING AND PRESSURIZED DISPENSING SYSTEM AND METHOD

(75) Inventors: Paul Drube, Burnsville, MN (US); Timothy Neeser, Savage, MN (US); Thomas Carey, Woodstock, GA (US)

(73) Assignee: Chart Inc., Garfield Heights, OH (US)

( * ) Notice: Subject to any disclaimer, the term of this patent is extended or adjusted under 35 U.S.C. 154(b) by 183 days.

(21) Appl. No.: 13/216,666

(22) Filed: Aug. 24, 2011

(65) Prior Publication Data

US 2012/0048881 A1 Mar. 1, 2012

Related U.S. Application Data

(60) Provisional application No. 61/376,884, filed on Aug. 25, 2010.

(51) Int. Cl.

| | |
|---|---|
| ***B67D 7/08*** | (2010.01) |
| ***B67D 7/80*** | (2010.01) |
| ***F17C 7/02*** | (2006.01) |

(52) U.S. Cl.

CPC ..... *F17C 7/02* (2013.01); *F17C 2201/0104* (2013.01); *F17C 2201/032* (2013.01);
(Continued)

(58) Field of Classification Search

CPC ..... F17C 7/02; F17C 2203/0391; F17C 2227/0341; F17C 2223/0169;
(Continued)

(56) References Cited

U.S. PATENT DOCUMENTS 2,632,306 A * 3/1953 Ruff ..... F24F 5/00 165/240
2,951,348 A * 9/1960 Bliss ..... F17C 3/08 141/82

(Continued)

FOREIGN PATENT DOCUMENTS

EP 2 453 160 A2 5/2012
WO WO 2004/005791 A2 1/2004

OTHER PUBLICATIONS

European Search Report from corresponding European Patent Application No. 11250739.7 dated Dec. 17, 2013.

(Continued)

*Primary Examiner* — Kun Kai Ma
(74) *Attorney, Agent, or Firm* — Cook Alex Ltd.; R. Blake Johnston

(57) ABSTRACT

A system and method for dispensing subcooled $CO_2$ liquid includes a vacuum insulated bulk tank containing a supply of the liquid $CO_2$. A pressure builder having an inlet in communication with a bottom portion of the bulk tank and an outlet in communication with a top portion of the bulk tank vaporizes liquid from the bulk tank and delivers the resulting gas to the top portion of the tank so as to pressurize it. A baffle is positioned within the bulk tank. Below the baffle, a refrigeration system is connected to the heat exchanger coil so that a refrigerant fluid is supplied to and received from the heat exchanger coil so that the liquid below the baffle is subcooled and the liquid above the baffle is stratified. A liquid fill line is in communication with the interior of the bulk tank via a fill line opening that is positioned above the baffle. A liquid feed line is in communication with a bottom portion of the interior of the bulk tank so that subcooled liquid may be dispensed.

45 Claims, 6 Drawing Sheets

(52) U.S. Cl.
CPC ..... *F17C 2203/0391* (2013.01); *F17C 2203/0629* (2013.01); *F17C 2203/0643* (2013.01); *F17C 2205/018* (2013.01); *F17C 2205/0326* (2013.01); *F17C 2205/0332* (2013.01); *F17C 2205/0338* (2013.01); *F17C 2221/013* (2013.01); *F17C 2223/0169* (2013.01); *F17C 2223/035* (2013.01); *F17C 2223/041* (2013.01); *F17C 2227/0107* (2013.01); *F17C 2227/0341* (2013.01); *F17C 2227/0374* (2013.01); *F17C 2250/032* (2013.01); *F17C 2250/043* (2013.01); *F17C 2250/0439* (2013.01); *F17C 2250/0626* (2013.01); *F17C 2270/05* (2013.01)

(58) Field of Classification Search
CPC ..... F17C 2270/05; F17C 2250/0626; F17C 2227/0107; F17C 2205/0338; F17C 2223/041
USPC ..... 62/47.1, 50.1, 48.2, 48.3, 45.1, 45.2, 7; 220/501, 503
See application file for complete search history.

(56) References Cited

U.S. PATENT DOCUMENTS

| | | | | | |
|---|---|---|---|---|---|
| 3,108,446 | A | * | 10/1963 | Yoshitoshi Sohda et al. | 62/48.2 |
| 3,419,174 | A | | 12/1968 | Engdahl et al. | |
| 4,094,774 | A | * | 6/1978 | Smith | 210/612 |
| 4,187,689 | A | * | 2/1980 | Selcukoglu | F17C 9/00 62/48.2 |
| 4,296,610 | A | * | 10/1981 | Davis | 62/50.1 |
| 4,474,018 | A | * | 10/1984 | Teagan | F24D 17/02 237/2 B |
| 4,695,302 | A | * | 9/1987 | Tyree, Jr. | C01B 31/22 62/384 |
| 4,888,955 | A | * | 12/1989 | Tyree et al. | 62/47.1 |
| 5,415,001 | A | | 5/1995 | Powars | |
| 5,590,535 | A | | 1/1997 | Rhoades | |
| RE35,874 | E | * | 8/1998 | Neeser et al. | 62/7 |
| 6,044,647 | A | * | 4/2000 | Drube | F17C 7/02 141/2 |
| 6,260,361 | B1 | * | 7/2001 | Tyree, Jr. | F17C 7/00 62/54.1 |
| 6,354,088 | B1 | * | 3/2002 | Emmer | F17C 5/007 141/82 |
| 6,367,264 | B1 | | 4/2002 | Tyree, Jr. et al. | |
| 7,347,053 | B1 | * | 3/2008 | Haberbusch | F25B 9/145 62/49.2 |
| 7,581,405 | B2 | * | 9/2009 | Higginbotham et al. | 62/47.1 |
| 2002/0104581 | A1 | * | 8/2002 | Drube | F17C 5/02 141/82 |
| 2003/0126867 | A1 | * | 7/2003 | Drube et al. | 62/50.2 |
| 2004/0055315 | A1 | * | 3/2004 | Drube | F17C 5/06 62/50.2 |
| 2005/0056027 | A1 | * | 3/2005 | White | 62/50.5 |
| 2005/0132719 | A1 | * | 6/2005 | Svensson et al. | 62/50.1 |
| 2006/0218941 | A1 | * | 10/2006 | Drube | F17C 5/02 62/50.2 |
| 2007/0193282 | A1 | * | 8/2007 | Grayson | F17C 3/10 62/45.1 |
| 2007/0214831 | A1 | * | 9/2007 | Nanda | B01D 5/0003 62/614 |
| 2007/0215524 | A1 | * | 9/2007 | Stell et al. | 208/184 |
| 2009/0193817 | A1 | * | 8/2009 | Germain et al. | 62/51.1 |
| 2010/0293969 | A1 | * | 11/2010 | Braithwaite | A23B 4/08 62/62 |
| 2015/0362128 | A1 | * | 12/2015 | Sanglan | F17C 7/04 62/50.2 |

OTHER PUBLICATIONS

European Search Report dated Dec. 9, 2015 for European Application No. EP 14157104.

* cited by examiner

BULK LIQUID COOLING AND PRESSURIZED DISPENSING SYSTEM AND METHOD

CLAIM OF PRIORITY

This application claims priority to provisional patent application No. 61/376,884, filed Aug. 25, 2010.

FIELD OF THE INVENTION

The present invention generally relates to systems for storing, cooling and dispensing fluids and, more particularly, to an improved bulk liquid cooling and pressurized dispensing system and method.

BACKGROUND

It is well known that cryogenic liquids, or liquids having similar properties, have found great use in industrial refrigeration and freezing applications. For example, liquid carbon dioxide has found use as a commercial refrigerant due to its inert (does not react with plastic) and non-toxic nature and desirable range of refrigeration temperatures. It is typically stored at a pressure of 300 psig and a corresponding equilibrium temperature of approximately 0° F. and then, during dispensing, expanded at atmospheric pressure where it transforms into solid phase $CO_2$ "snow" or dry ice and $CO_2$ vapor. In addition to providing refrigeration, it may also be used in various processes to freeze food items such as hamburger patties or chicken nuggets and the like for shipping and/or storage.

When dispensing the liquid $CO_2$ at pressures around 300 psig, it is known that lowering the temperature below 0° F., in other words, subcooling the liquid, produces a larger percentage of $CO_2$ snow and a smaller percentage of $CO_2$ vapor. As a result, a dispensing system derives higher efficiency by being able to deliver subcooled, high pressure $CO_2$. The corresponding economic advantage increases as the temperature of the liquid $CO_2$ decreases.

In recognition of the above, the system of U.S. Pat. No. 4,888,955 to Tyree, Jr. et al. was developed. The system of the Tyree '955 patent stores liquid $CO_2$ in an insulated tank having a height greater than its internal diameter. A pressure of approximately 300 psig is maintained in the head space of the tank via condensation of vapor therein. Liquid $CO_2$ is withdrawn from the upper portion of the tank and is subcooled outside of the tank by a heat exchanger of an external refrigeration system. The resulting subcooled $CO_2$ liquid is returned to the bottom portion of the tank so that stratification of the $CO_2$ in the tank occurs and a thermocline region is created within the bottom portion of the tank. Subcooled liquid $CO_2$ may then be dispensed from the bottom of the tank due to the approximate 300 psig pressure within the top portion of the tank. The refrigeration system operates during "off hours" to replenish the thermocline region with subcooled $CO_2$.

While the system of the Tyree '955 patent performs well, some food freezing applications do not permit off hours between refills of liquid $CO_2$. It is therefore desirable to provide a system that can operate continuously between refills, and even during refills, of liquid $CO_2$. Furthermore, the ability to reduce the migration of the chilled liquid from the bottom portion of the tank to the warmer liquid in the top portion of the tank, beyond the insulation provided by stratification, would allow the system to operate more efficiently. This would result in less liquid $CO_2$ usage and a smaller compressor in the refrigeration system.

DETAILED DESCRIPTION OF EMBODIMENTS

Figure 1A:
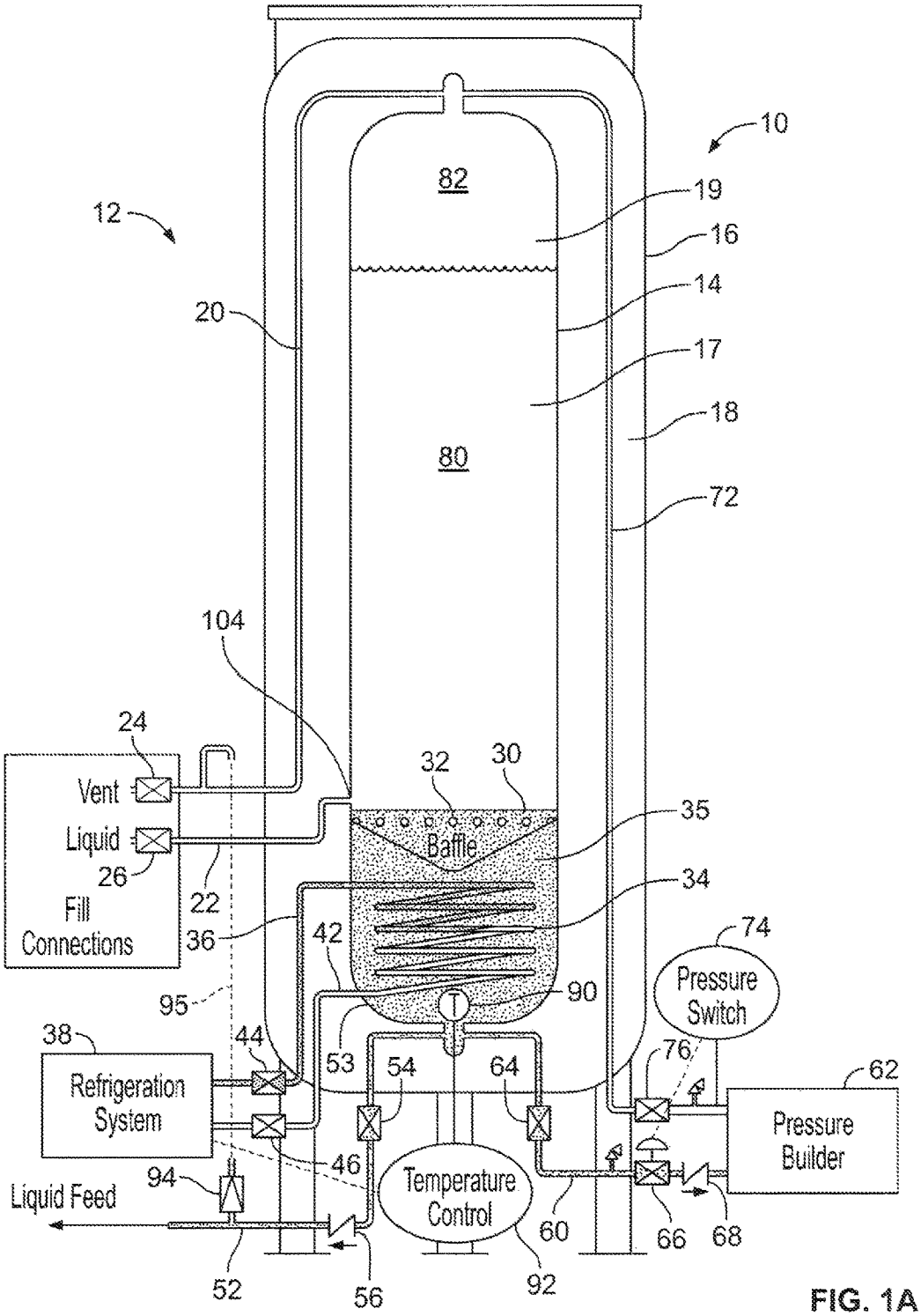
FIGS. 1A-1C are schematic views illustrating an embodiment of the system and method of the present invention with the liquid $CO_2$ tank filled, approximately half full and in need of refilling, respectively.
Figure 1B:
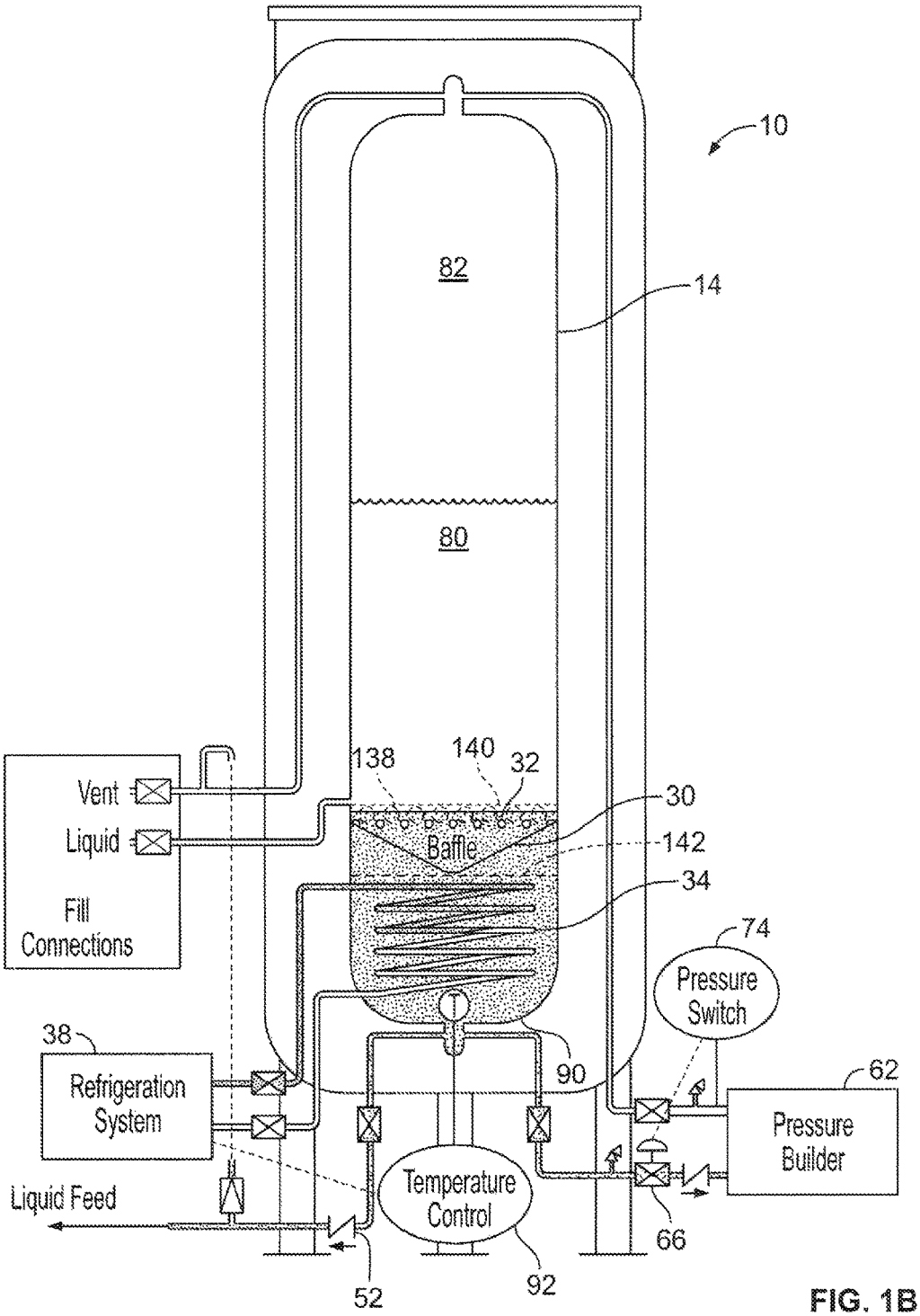
Figure 1C:
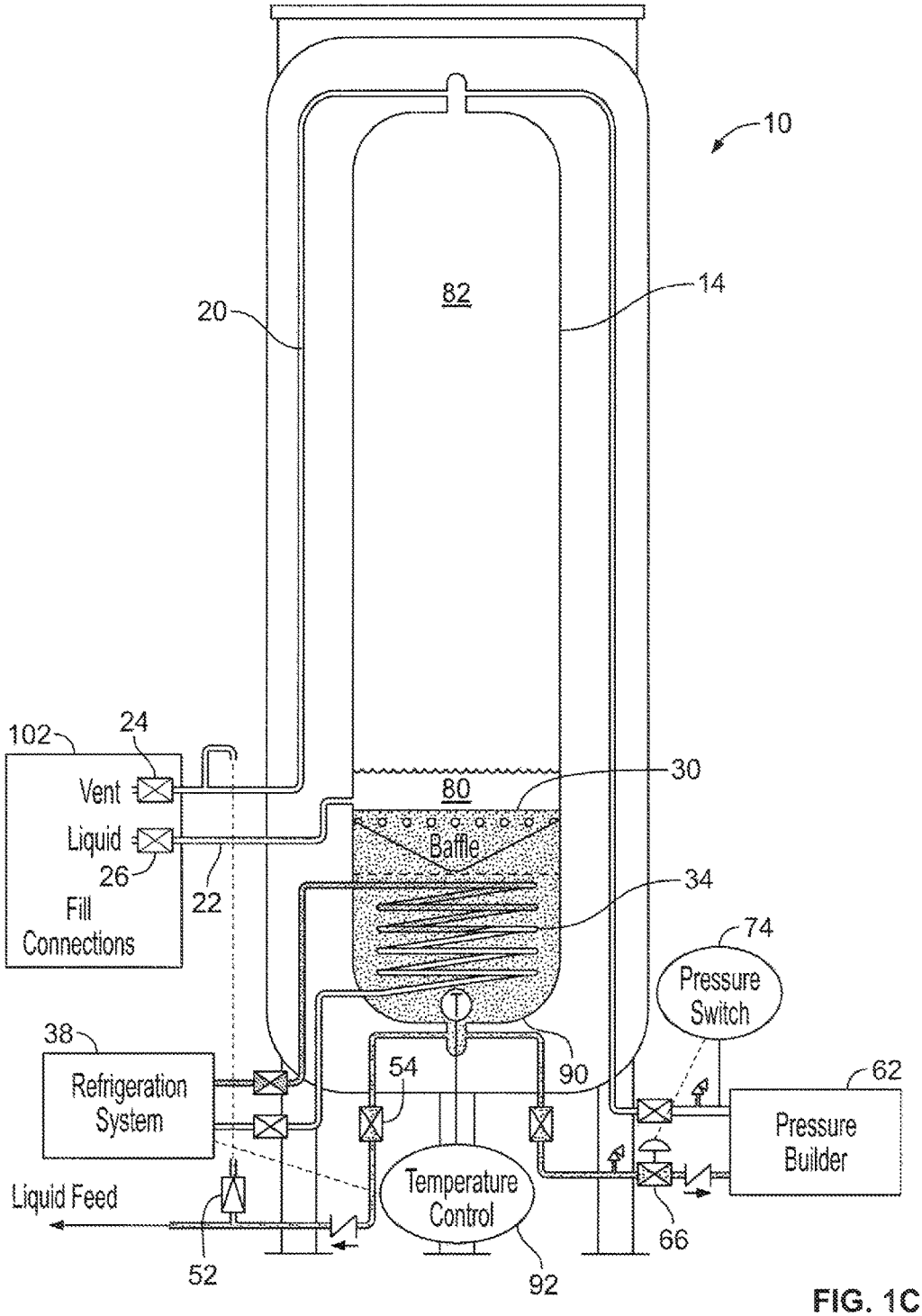

An embodiment of the system of the present invention is indicated in general at 10 in FIGS. 1A-1C. The system includes a bulk tank, indicated in general at 12, that includes an inner tank 14 surrounded by outer jacket 16. The tank preferably is vertically oriented, being sized so as to have a height that is greater than the width of the interior 17 of the inner tank 14. Inner tank 14 is preferably sized to hold a reservoir of liquid having a depth of at least 6 feet. The annular insulation space 18 defined between the inner tank 14 and outer jacket 16 may be vacuum-insulated and/or at least partially filled with an insulation material so that inner tank 14 is insulated from the ambient environment. As an example only, the insulation material may include multiple layers of paper and foil that are preferably combined with the vacuum insulation in the annular insulation space.

When used for food freezing and/or refrigeration processes, the inner tank 14 is preferably constructed of grade T304 stainless steel (food grade). Such an inner tank provides operating temperatures down to −320° F. at pressures of around 350 psig. Outer jacket 16 is preferably constructed of high grade carbon steel. Pre-existing tanks could be retrofitted with stainless steel inner tanks for use in food processing applications of the present invention.

While the invention will be described below in terms of liquid carbon dioxide for use in food refrigeration and/or freezing processes, it should be understood that the invention may be used for other liquids useful in refrigeration and/or freezing related processes, including cryogenic liquids.

As illustrated in FIGS. 1A-1C, the inner tank 14 features a top portion 19 to which a fill vent line 20 is connected. In addition, a liquid fill line 22 is connected to a lower portion of the inner tank 14, as will be described in greater detail below. The distal end of the fill vent line 20 is provided with a fill vent valve 24 while the distal end of the liquid fill line 22 is provided with liquid fill valve 26, and both are adapted to be connected to a source of liquid, such as a tanker truck, for refilling the bulk tank. The fill vent line 20 provides a vapor balance during the refilling operation.

A baffle 30 is positioned within the lower portion of the interior tank 14. The baffle is preferably constructed of stainless steel and has a thickness of approximately 0.105 inches. The baffle features a shallow cone shape and is circumferentially secured to the interior surface of the inner tank 14. The baffle features a number of openings 32 that permit passage of liquid. The functionality of the baffle will be explained below.

An internal heat exchanger coil 34 is positioned in the bottom portion 35 of the tank and is connected by coil inlet line 36 to a refrigeration system 38. A coil outlet line 42 joins the internal heat exchanger coil 34 to the refrigeration system 38 as well. Coil inlet line 36 optionally includes a coil inlet valve 44 while coil outlet line 42 optionally includes a coil outlet valve 46.

Figure 5:
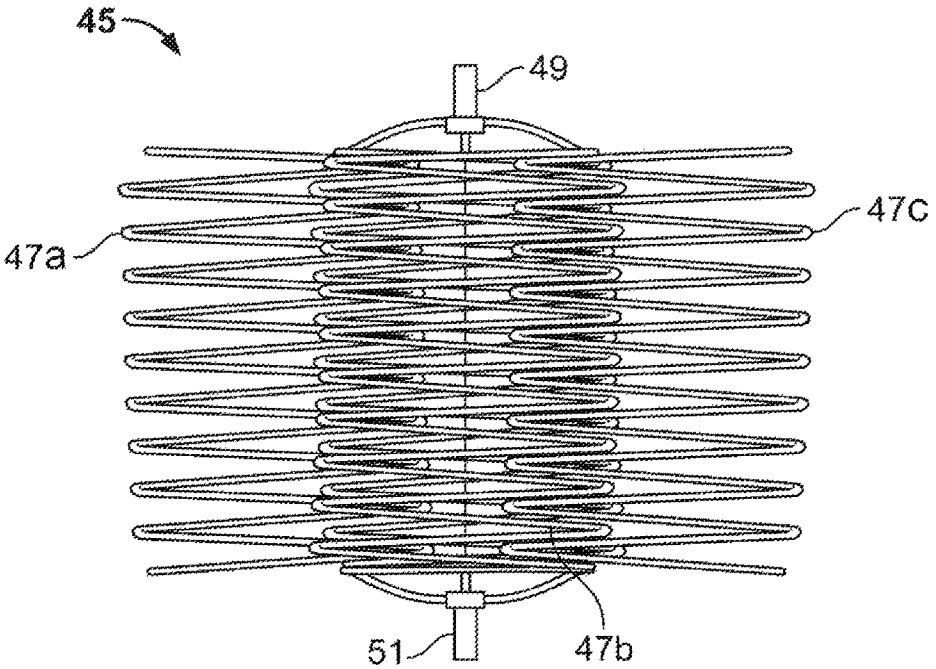
FIG. 5 is a side elevational view of the heat exchanger coil of FIG. 4.
Figure 4:
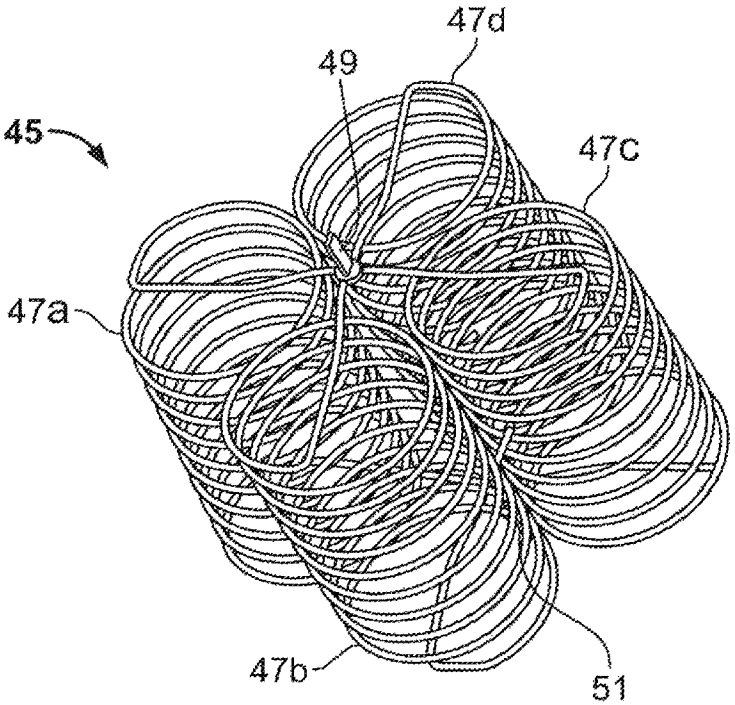
FIG. 4 is a perspective view showing an alternative embodiment of the heat exchanger coil of the system and method of the present invention.

While a single coil heat exchanger is indicated at 34 in FIGS. 1A-1C, the heat exchanger could alternatively feature a number of coils, connected either in series or in parallel or both. For example, an alternative embodiment of the heat exchanger coil 34 is indicated in general at 45 in FIGS. 4 and 5. As indicated in FIGS. 4 and 5, the heat exchanger 45 includes four coils 47*a*, 47*b*, 47*c* and 47*d* connected in parallel with an inlet 49 and an outlet 51. Alternatively, coils 47*a*-47*d* could be connected in series. As another example, the heat exchanger coil may include two or more concentric coils connected in parallel or in series.

A liquid dispensing or feed line 52 exits the bottom 53 of the inner tank 14 and is provided with liquid feed valve 54 and liquid feed check valve 56.

A pressure builder inlet line 60 also exits the bottom portion of the inner tank 14 and connects to the inlet of pressure builder 62. The pressure builder inlet line 60 is provided with a pressure builder inlet valve 64, and automated pressure builder valve 66 and a pressure builder check valve 68. A pressure builder outlet line 72 exits that pressure builder 62 and travels to the top of the inner tank 14. The pressure builder outlet line 72 is provided with a pressure switch 74 and a pressure builder outlet valve 76. As will be explained in greater detail below, the pressure switch 74 is connected to the automated pressure builder valve 66.

In operation, with reference to FIG. 1A, after the tank 12 has been filled, the inner tank 14 contains a supply of liquid $CO_2$ 80 with a headspace 82 defined above. Fill valves 24 and 26, feed valve 54 and automated pressure builder valve 66 are closed, while coil inlet and outlet valves 44 and 46 and pressure builder inlet and outlet valves 64 and 76 are open. While the description below assumes that the feed valve 54 is closed, it may be open in alternative modes of operation, also described below. As an example only, the refill transport provides the liquid $CO_2$ at a pressure of approximately 270 psig and a temperature of approximately −10° F.

The pressure switch 74 senses the pressure in headspace 82 via pressure builder outline line 72. If the pressure is below the target pressure of 300 psig, the pressure switch 74 opens automated pressure builder valve 66 so that liquid $CO_2$ flows to the pressure builder 62. The liquid $CO_2$ is vaporized in the pressure builder and the resulting gas travels through line 72 to the headspace 82 so that the pressure in inner tank 14 is increased. Pressure builder check valve 68 prevents burp backs through the pressure builder inlet line 60 and into the bottom of the tank that could cause undesirable mixing between the liquid $CO_2$ below the baffle and the remaining liquid $CO_2$ above the baffle. Pressure building continues until pressure switch 74 detects the target pressure of 300 psig in the inner tank 14. When the pressure switch detects the pressure of 300 psig, it will close the automated pressure builder valve 66 so that pressure building is discontinued. At this pressure, the liquid $CO_2$ 80 will have an equilibrium temperature of approximately 0° F.

The bottom portion of the tank is provided with a temperature sensor 90, such as a thermocouple, that communicates electronically with a temperature controller 92. Sensor 90 can alternatively be a pressure sensor or a saturation bulb. The temperature controller 92 controls operation of the refrigeration system 38 and may be a microprocessor or any other electronic control device known in the art. When the temperature controller detects, via the temperature sensor, a temperature that is higher than the desired or target temperature, it activates the refrigeration system 38. Continuing with the present example, the temperature sensor detects the 0° F. temperature of the liquid $CO_2$ in the inner tank and activates the refrigeration system 38. A refrigerant fluid in liquid form then travels through line 36 to the internal heat exchanger coil 34 and is vaporized so as to subcool the liquid $CO_2$ in the bottom portion of inner tank 14. The vaporized refrigerant fluid travels back to the refrigeration system 38 via line 46 for regeneration. More specifically, the refrigeration system 38 includes a condenser for re-liquefying the refrigerant fluid. As an example only, the refrigerant fluid is preferably R-404A/R-507.

The refrigeration system and internal heat exchanger coil continue to subcool the liquid $CO_2$ in the bottom portion of the inner tank until the target temperature, −40° F. for example, is reached. The temperature controller 92 senses that the target temperature has been reached, via the temperature sensor 90, and shuts down the refrigeration system 38.

Due to stratification in the inner tank and the baffle 30, even though the liquid $CO_2$ below the baffle has been subcooled, the pressure remains at 300 psig for pushing the liquid $CO_2$ from the tank during dispensing. The headspace 82 preferably operates at 300 psig to allow direct replacement of older systems so as not to alter the food freezing equipment set up for 300 psig. More specifically, stratification occurs throughout the liquid $CO_2$ 80 between the $CO_2$ gas in the headspace 82 of the inner tank and the subcooled liquid $CO_2$ in the bottom portion of the tank. The baffle assists in the stratification by creating a cold zone in the bottom of the tank that is mostly insulated from the remaining liquid $CO_2$ above the baffle. This improves the efficiency of the internal heat exchanger coil in subcooling the liquid beneath the baffle and inhibits migration of the subcooled liquid into the warmer liquid above the baffle. As a result, the tank holds an inventory of high pressure equilibrium liquid $CO_2$ in the region above the baffle, similar to that available from a conventional high pressure storage vessel, and an inventory of high pressure, subcooled liquid $CO_2$ in the region or zone below the baffle.

As an example only, for a tank having an inner tank height of 29 feet, and an inner tank width of 8 feet, the baffle 30 would ideally be positioned 7 feet from the bottom of the tank. In general, the baffle 30 is preferably positioned approximately 24% of the total height of the inner tank from the bottom of the inner tank or at a level where approximately 30% of the tank volume is below the baffle.

When the tank target pressure and target subcooled liquid temperature have been reached, the liquid feed valve 54 may be opened so that the subcooled liquid $CO_2$ may be dispensed through feed line 52 and expanded at atmospheric pressure to make snow or otherwise used for a food freezing or refrigeration process. In an alternative mode of operation, the liquid feed valve 54 may be left open during filling for operation of the system during filling or prior to full refrigeration at a reduced efficiency. Check valve 56 prevents burp backs through the feed line 52 and into the bottom of the tank that could cause undesirable mixing between the subcooled liquid $CO_2$ and the remaining liquid $CO_2$ above the baffle.

As illustrated in FIG. 1A, the liquid feed line 52 is provided with a pressure relief check valve 94 that communicates with fill vent line 20 via liquid feed vent line 95. In the event that the pressure within the feed line 52 rises above a predetermined level, the pressure relief valve 94 automatically opens so that pressure is vented through line 20.

As illustrated in FIG. 1B, the level of the liquid $CO_2$ 80 drops as liquid $CO_2$ is dispensed through feed line 52. As this occurs, liquid $CO_2$ travels from the region above the baffle 30, through the openings 32 of the baffle, and into the zone below the baffle. Temperature sensor 90 constantly monitors the temperature of the liquid $CO_2$ in the zone below baffle 32 and pressure switch 74 constantly monitors the pressure within the head space 82 abaft the liquid $CO_2$. The pressure switch opens the automated pressure building valve 66 as is necessary to maintain and hold the tank operating pressure at approximately 300 psig via the pressure builder 62. Temperature sensor 90 and temperature controller 92 similarly activate refrigeration system 38 as is necessary to maintain the temperature of the liquid $CO_2$ in the zone below the baffle at approximately −40° F. via the internal heat exchanger coil 34.

It should be noted that alternative automated control arrangements known in the art may be substituted for the temperature sensor and controller 90 and 92 and/or the pressure switch and automated pressure building valve 74 and 66. For example, in an alternative embodiment of the system, a single system programmable logic controller (PLC) is connected to a pressure sensor in the head space 82 of the tank and the temperature sensor 90 so as to control operation of the refrigeration system 38 and the pressure builder 62.

With reference to FIG. 1C, when the level of liquid $CO_2$ reaches 25% above the baffle 30, dispensing of liquid $CO_2$ through feed line 52 may be halted by closing feed valve 54. In the PLC embodiment, feed valve 54 is automated and a liquid level detector, which is in communication with the PLC, is positioned in the tank. The liquid level detector signals the PLC when the liquid level in the tank reaches the 20% above baffle 30 level, and the PLC then automatically shuts the feed valve 54 and provides a notification to the user, such as an illuminated light or audible warning.

It should be noted that liquid may be dispensed to levels lower than 25% above the baffle, but the heat exchanger coil 34 may become less efficient as the liquid level drops lower than the coil.

A tanker truck, or other liquid $CO_2$ delivery source, is connected to the fill vent line 20 and the liquid fill line 22 via fill connections 102. Fill vent valve 24 and liquid fill valve 26 are opened so that the inner tank 14 is refilled with liquid $CO_2$.

As an alternative to shutting feed valve 54, when the level of liquid $CO_2$ in the tank reaches the level 20% above the baffle, 32, the tanker truck, or other $CO_2$ liquid delivery source, may be connected to fill connections 102, and the dispensing of liquid $CO_2$ may continue uninterrupted. The pressure builder 62 and refrigeration system 38 and coil 34 operate under the direction of the pressure switch 74 and automated pressure building valve 66 and the temperature sensor 90 and temperature controller 92 as described above to maintain the approximate 300 psig pressure and −40° F. temperature (below baffle 30) within inner tank 14. As a result, the system permits the delivery of subcooled liquid $CO_2$ to continue uninterrupted.

As noted previously, the baffle 30 helps separate the liquid underneath the baffle from the liquid above so that the liquid below is not disturbed. This increases the efficiency in creating and maintaining the subcooled state of the liquid $CO_2$ below the baffle. Positioning the fill line opening 104 of the liquid fill line 22 above the baffle helps prevent the incoming liquid $CO_2$ from disturbing the subcooled liquid $CO_2$ under the baffle, which further aids in increasing efficiency in creating and maintaining the subcooled state of the liquid $CO_2$ below the baffle.

An example of a suitable pressure builder 62 is the sidearm $CO_2$ vaporizer available from Thermax Inc. of South Dartmouth, Mass. An example of a suitable refrigeration system 38 is the Climate Control model no. CCU1030ABEX6D2 condensing unit available from Heatcraft Refrigeration Products, LLC of Stone Mountain, Ga.

Figure 2:
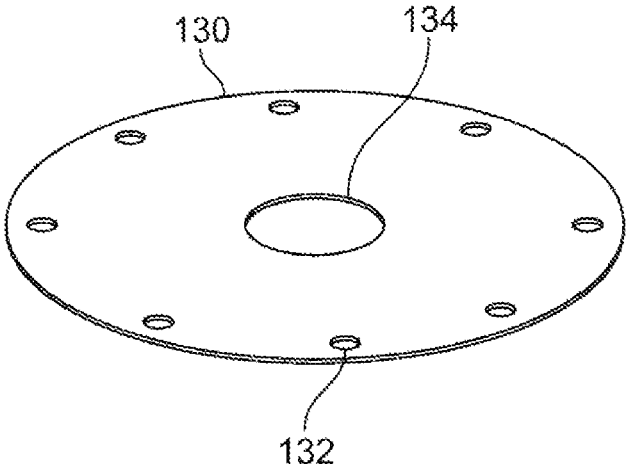
FIG. 2 is a perspective view of an alternative embodiment of the baffle of the system of the present invention.

While the baffle of FIGS. 1A-1C is shown to be cone shaped, the baffle alternatively could be provided with a disk shape, as illustrated at 130 in FIG. 2. The baffle 130 is also preferably constructed from stainless steel that is approximately 0.105 inches thick and includes openings 132 and 134 to permit liquid $CO_2$ to travel from the upper region of inner tank 114 to the zone or region below the baffle.

As yet another alternative embodiment of the baffle, the baffle takes the form of a plurality of glass or polystyrene foam (such as STYROFOAM) insulation beads, indicated in phantom at 138 in FIG. 1B, that float between upper and lower screens 140 and 142, respectively. The screens may be mounted to ring-like frames that are circumferentially attached to the interior surface of inner tank 13. The bead material is chosen so that the beads have a density which allows them to float on the denser subcooled liquid CO2 up to the level of upper screen 140. The beads are large enough in both size and number that the cross section of the inner tank 14 is generally covered. As a result, the beads form a floating baffle arrangement that creates an insulation layer between the subcooled liquid CO2 below and the remaining liquid CO2 above. In this regard, reference is made to U.S. Pat. No. RE35,874, the contents of which are hereby incorporated by reference.

Figure 3:
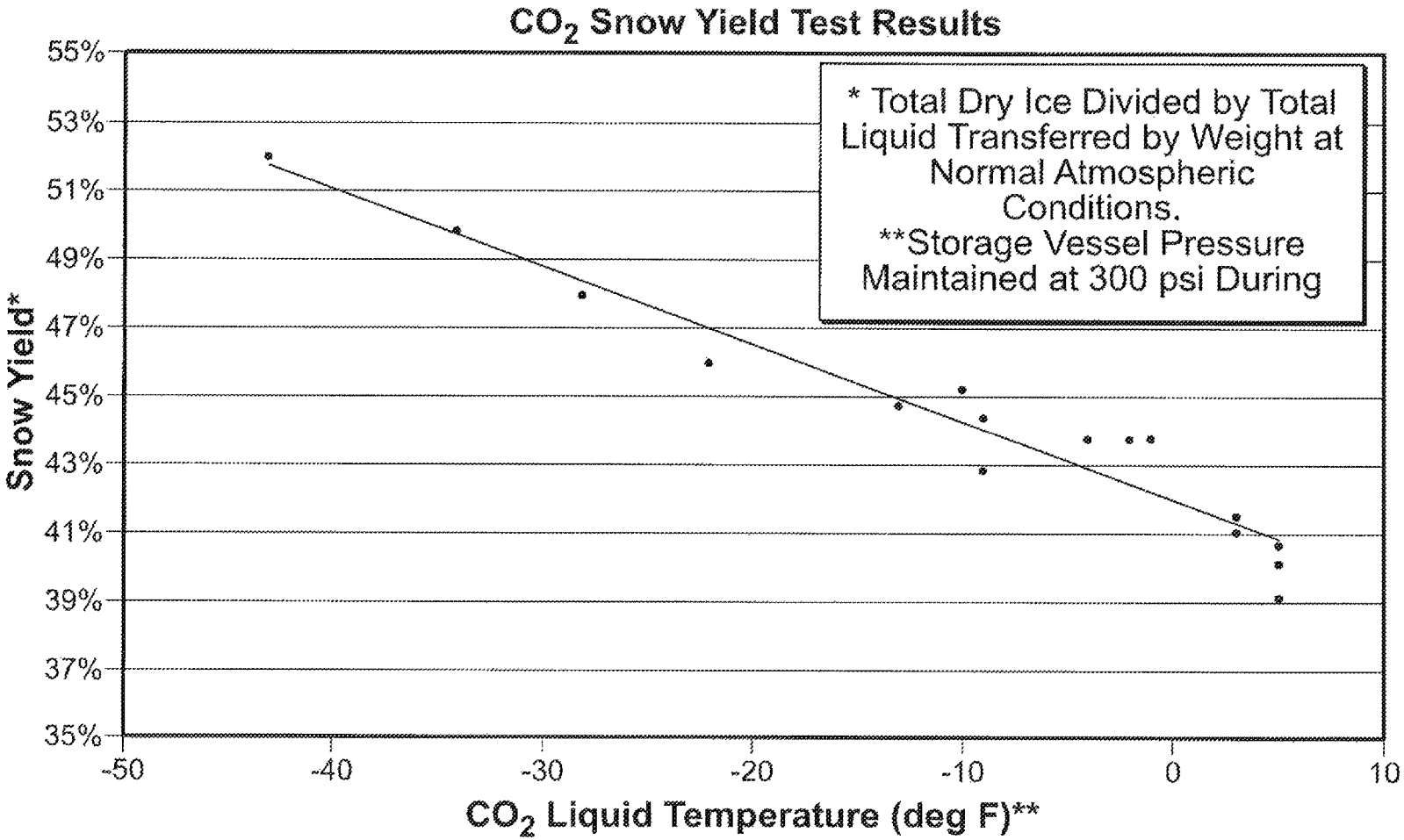
FIG. 3 is a graph illustrating improvements in snow yield v. temperature possible with the system of FIGS. 1A-1C.

By dispensing subcooled liquid $CO_2$, the present invention improves snow yield when the liquid is expanded to ambient pressure, as illustrated in FIG. 3. More specifically, by subcooling the liquid $CO_2$ in the region or zone below the baffle, the snow yield rises from slightly over 42% for liquid $CO_2$ at equilibrium temperature for 0° F. to over 52% at equilibrium temperature for −43° F. This equates to an increase in refrigeration capacity of the subcooled liquid $CO_2$, which permits faster food throughput in food freezing operations. An example of suitable snow making equipment (snowhorn), which was used to create the data of FIG. 3, is available from Gray Tech Carbonic, Inc.

The increase in snow yield and refrigeration capacity of the invention results in less carbon dioxide consumption. As a result, there is less $CO_2$ gas delivered to the environment, which makes the system and method of the invention a "green" technology. In addition, the baffle of the system increases the efficiency of the refrigeration system in subcooling the liquid $CO_2$ below the baffle. This permits smaller, and thus more efficient, compressors to be used in the refrigeration system.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for dispensing subcooled liquid comprising:

a. a bulk tank including a side wall and defining an interior that is adapted to contain a supply of the liquid;

b. a pressure builder;

c. a pressure builder inlet line in communication with a bottom portion of the interior of the bulk tank and an inlet of the pressure builder;

d. a pressure builder outlet line in communication with a top portion of the interior of the bulk tank and an outlet of the pressure builder;

e. a heat exchanger coil positioned in the bottom portion of the interior of the bulk tank, said heat exchanger coil having a coil inlet line and a coil outlet line;

f. a refrigeration system connected to the heat exchanger coil inlet line and the coil outlet line so that a refrigerant fluid is supplied to and received from the heat exchanger coil;

g. a baffle positioned within the interior of the tank and fixedly secured and circumferentially adjacent to said bulk tank wall above the heat exchanger coil and configured to be submerged in liquid contained in the interior of the bulk tank so that liquid beneath the baffle is subcooled by the heat exchanger and liquid above the baffle is stratified, said baffle also configured to inhibit migration of subcooled liquid to the stratified liquid above the baffle and to inhibit disturbances to the subcooled liquid below the baffle;

h. a liquid fill line in communication with the interior of the bulk tank via a fill line opening that is positioned above the baffle and within the bulk tank side wall so as to be configured to be submerged in liquid contained in the interior of the bulk tank and prevent incoming liquid flowing through the fill line opening from disturbing the subcooled liquid below the baffle so as to increase efficiency in creating and maintaining a subcooled state of the subcooled liquid below the baffle, said liquid fill line having a distal end adapted to be connected to a source of liquid for refilling the bulk tank;

i. a fill vent line in communication with the top portion of the interior of the bulk tank, said fill vent line having a distal end adapted to be connected to the source of liquid during refilling of the bulk tank;

j. a liquid dispensing line in communication with a bottom portion of the interior of the bulk tank, said liquid dispensing line positioned below the baffle so that subcooled liquid may be dispensed through the liquid dispensing line; and k. said baffle also configured so that liquid from above the baffle travels past the baffle into a zone below the baffle and is subcooled by the heat exchanger coil as subcooled liquid is dispensed through the dispensing line.

2. The system of claim 1 wherein the bulk tank includes an inner tank, which defines the interior of the bulk tank, and an outer jacket surrounding the inner tank so that an annular insulation space is defined between the inner tank and the outer jacket.

3. The system of claim 2 wherein the annular insulation space is vacuum insulated.

4. The system of claim 2 wherein the annular insulation space contains insulation material.

5. The system of claim 2 wherein the inner tank is constructed from stainless steel.

6. The system of claim 1 wherein the liquid is liquid $CO_2$.

7. The system of claim 1 wherein the baffle is circumferentially secured to an interior surface of the bulk tank.

8. The system of claim 1 further comprising:

k. a temperature sensor positioned in the bottom portion of the interior of the inner tank;

l. a temperature controller in communication with the temperature sensor and the refrigeration system, said temperature controller activating the refrigeration system when a liquid in the bottom portion of the bulk tank is above a predetermined temperature.

9. The system of claim 1 further comprising a pressure switch in communication with a top portion of the interior of the inner tank and an automated pressure builder valve positioned within the pressure builder inlet line, said pressure switch opening the automated pressure builder valve when the pressure within the bulk tank is below a predetermined pressure.

10. The system of claim 9 wherein the pressure switch is positioned within the pressure builder outlet line.

11. The system of claim 1 wherein the liquid dispensing line includes a liquid feed check valve so that burp backs through the liquid dispensing line are prevented during dispensing.

12. The system of claim 1 wherein the pressure builder inlet line includes a pressure builder check valve.

13. The system of claim 1 further comprising a liquid feed vent line in communication with the liquid dispensing line and the fill vent line, said liquid feed vent line including a pressure relief valve.

14. The system of claim 1 wherein the baffle is cone shaped and features a plurality of openings.

15. The system of claim 1 wherein the baffle is disk shaped and features a plurality of openings.

16. The system of claim 1 further comprising an upper screen and a lower screen vertically spaced from one another and each circumferentially attached to an interior surface of the inner tank above the heat exchanger coil and wherein the baffle includes a plurality of beads positioned between the upper and lower screens.

17. The system of claim 16 wherein the beads are constructed of polystyrene foam or glass.

18. The system of claim 1 wherein the interior of the bulk tank includes a top, a bottom and a height defined there between and wherein the baffle is positioned approximately 24% of the height above the bottom.

19. The system of claim 1 wherein the interior of the tank defines a volume and wherein the baffle is positioned so that approximately 30% of the tank volume is below the baffle.

20. The system of claim 1 wherein the baffle includes a plurality of openings that are adapted to permit liquid from above the baffle to pass into liquid below the baffle for subcooling as liquid is dispensed through the liquid dispensing line.

21. The system of claim 1 wherein the liquid is liquid carbon dioxide and further comprising a snowhorn connected to the liquid dispensing line and configured to expand subcooled liquid carbon dioxide received from the dispensing line at atmospheric pressure so that snow is produced.

22. The system of claim 21 wherein the refrigeration system and the heat exchanger coil are configured to subcool the liquid carbon dioxide to −40° F. or lower and the pressure builder is configured to pressurize the bulk tank to 300 psi and a snow yield of approximately 50% or more is produced by the snowhorn.

23. A system for dispensing subcooled liquid comprising:

a. a bulk tank containing a supply of the liquid and including a bulk tank side wall;

b. a pressure builder;

c. said pressure builder having an inlet in communication with a bottom portion of the bulk tank and an outlet in communication with a top portion of the bulk tank, said pressure builder vaporizing liquid from the bulk tank and delivering the resulting gas to the top portion of the tank so as to pressurize it;

d. a baffle positioned within and fixedly secured to the bulk tank, so as to be circumferentially adjacent to the bulk tank wall; and submerged in the liquid;

e. a heat exchanger coil positioned in the bottom portion of the bulk tank below the baffle, said heat exchanger coil having a coil inlet line and a coil outlet line;

f. a refrigeration system connected to the heat exchanger coil inlet line and outlet line so that a refrigerant fluid is supplied to and received from the heat exchanger coil so that the liquid below the baffle is subcooled and the liquid above the baffle is stratified and said baffle inhibiting migration of subcooled liquid to the stratified liquid above the baffle and inhibiting disturbances to the subcooled liquid below the baffle;

g. a liquid fill line in communication with an interior of the bulk tank via a fill line opening that is positioned above the baffle and within the bulk tank side wall so as to be submerged in the supply of liquid contained in the bulk tank and prevent incoming liquid flowing through the fill line opening from disturbing the subcooled liquid below the baffle so as to increase efficiency in creating and maintaining a subcooled state of the subcooled liquid below the baffle, said liquid fill line having a distal end adapted to be connected to a source of liquid for refilling the bulk tank;

h. a fill vent line in communication with the top portion of the interior of the bulk tank, said fill vent line having a distal end adapted to be connected to the source of liquid during refilling of the bulk tank;

i. a liquid dispensing line in communication with a bottom portion of the interior of the bulk tank, said liquid dispensing line positioned below the baffle so that so that subcooled liquid may be dispensed through the liquid dispensing line; and j. said baffle also configured so that liquid from above the baffle travels past the baffle into a zone below the baffle and is subcooled by the heat exchanger coil as subcooled liquid is dispensed through the dispensing line.

24. The system of claim 23 wherein the bulk tank includes an inner tank, which defines the interior of the bulk tank, and an outer jacket surrounding the inner tank so that an annular insulation space is defined between the inner tank and the outer jacket.

25. The system of claim 24 wherein the annular insulation space is vacuum insulated.

26. The system of claim 24 wherein the annular insulation space contains insulation material.

27. The system of claim 24 wherein the inner tank is constructed from stainless steel.

28. The system of claim 23 wherein the liquid is liquid $CO_2$.

29. The system of claim 23 wherein the baffle is circumferentially secured to an interior surface of the bulk tank.

30. The system of claim 23 further comprising:

j. a temperature sensor positioned in the bottom portion of the interior of the inner tank;

k. a temperature controller in communication with the temperature sensor and the refrigeration system, said temperature controller activating the refrigeration system when the liquid in the bottom portion of the bulk tank is above a predetermined temperature.

31. The system of claim 23 further comprising a pressure switch in communication with a top portion of the interior of the inner tank and an automated pressure builder valve positioned within the pressure builder inlet line, said pressure switch opening the automated pressure builder valve when the pressure within the bulk tank is below a predetermined pressure.

32. The system of claim 31 wherein the pressure switch is positioned within the pressure builder outlet line.

33. The system of claim 23 wherein the liquid dispensing line includes a liquid feed check valve so that burp backs through the liquid dispensing line are prevented during dispensing.

34. The system of claim 23 wherein the pressure builder includes a pressure builder check valve.

35. The system of claim 23 further comprising a liquid feed vent line in communication with the liquid dispensing line and the fill vent line, said liquid feed vent line including a pressure relief valve.

36. The system of claim 23 further comprising an upper screen and a lower screen vertically spaced from one another and each circumferentially attached to an interior surface of the inner tank above the heat exchanger coil and wherein the baffle includes a plurality of beads positioned between the upper and lower screens.

37. The system of claim 36 wherein the beads are constructed of polystyrene foam or glass.

38. The system of claim 23 wherein the interior of the bulk tank includes a top, a bottom and a height defined there between and wherein the baffle is positioned approximately 24% of the height above the bottom.

39. The system of claim 23 wherein the interior of the tank defines a volume and wherein the baffle is positioned so that approximately 30% of the tank volume is below the baffle.

40. A method of dispensing subcooled liquid comprising the steps of:

a. providing a bulk tank including an interior and a bulk tank side wall and containing the liquid within the interior and a heat exchanger coil positioned in a bottom portion of the interior of the bulk tank with a baffle fixedly secured within and to the bulk tank, so as to be circumferentially adjacent to the bulk tank side wall, above the heat exchanger coil;

b. submerging the baffle within the liquid contained in the bulk tank;

c. directing an additional amount of the liquid into the interior of the bulk tank using a liquid fill line that is in communication with the interior of the bulk tank via a fill line opening that is positioned above the baffle and in the bulk tank side wall so as to be submerged in the liquid within the interior of the bulk tank and prevent the additional amount of liquid directed into the interior of the bulk tank from disturbing subcooled liquid below the baffle so as to increase efficiency in creating and maintaining a subcooled state of the subcooled liquid below the baffle;

d. vaporizing liquid from the bottom portion of the tank and directing it to a top of the bulk tank so as to pressurize the liquid;

e. stratifying the liquid above the baffle;

f. subcooling the liquid in the bottom portion of the tank below the baffle using the heat exchanger coil;

g. inhibiting migration of subcooled liquid to the stratified liquid above the baffle using said baffle;

h. dispensing the subcooled liquid from the bottom portion of the tank; and i. transferring liquid from above the baffle past the baffle into a zone below the baffle and subcooling the transferred liquid by the heat exchanger coil as subcooled liquid is dispensed through the dispensing line.

41. The method of claim 40 wherein the liquid is liquid $CO_2$.

42. The method of claim 40 further comprising the step of refilling the bulk tank with liquid via an opening in the bulk tank positioned above the baffle.

43. The method of claim 40 wherein the liquid is liquid carbon dioxide and further comprising the step of:

j. expanding the subcooled liquid carbon dioxide dispensed from the bottom portion of the bulk tank at atmospheric pressure to produce snow.

44. The method of claim 43 wherein step d. includes pressurizing the liquid carbon dioxide in the bulk tank to a pressure of 300 psi and step f. includes subcooling the liquid carbon dioxide to a temperature of −40° F. or lower and step j. includes producing a snow yield of approximately 50% or more.

45. The method of claim 43 wherein an additional amount of the liquid carbon dioxide is added to the interior of the bulk tank using the fill line during step j.

* * * * *